US010125513B2

(12) United States Patent
Jecel

(10) Patent No.: US 10,125,513 B2
(45) Date of Patent: Nov. 13, 2018

(54) GROUND ANCHOR WITH HOLDER FOR A LOAD

(71) Applicant: Bernhard Jecel, Maria Anzbach (AT)

(72) Inventor: Bernhard Jecel, Maria Anzbach (AT)

( * ) Notice: Subject to any disclaimer, the term of this patent is extended or adjusted under 35 U.S.C. 154(b) by 0 days.

(21) Appl. No.: 15/543,851

(22) PCT Filed: Jan. 7, 2016

(86) PCT No.: PCT/EP2016/000019
§ 371 (c)(1),
(2) Date: Jul. 14, 2017

(87) PCT Pub. No.: WO2016/113121
PCT Pub. Date: Jul. 21, 2016

(65) Prior Publication Data

US 2018/0010354 A1 Jan. 11, 2018

(30) Foreign Application Priority Data

Jan. 15, 2015 (AT) ..... A 50023/2015

(51) Int. Cl.
*E04H 12/22* (2006.01)
*E02D 5/80* (2006.01)

(52) U.S. Cl.
CPC ..... *E04H 12/2223* (2013.01); *E02D 5/801* (2013.01); *E04H 12/2238* (2013.01); *E04H 12/2269* (2013.01)

(58) Field of Classification Search
CPC ..... E04H 12/2223; E04H 12/2238; E04H 12/2269; E02D 5/801
USPC .... 52/155, 157, 161, 164, 165, 153; 248/85, 248/87, 156, 545
See application file for complete search history.

(56) References Cited

U.S. PATENT DOCUMENTS 3,313,505 A * 4/1967 Petrie ..... B25H 1/00 211/191
4,317,552 A * 3/1982 Weidler ..... F16M 11/16 211/203

(Continued)

FOREIGN PATENT DOCUMENTS

DE 20017386 U 1/2001
DE 202010016548 U 5/2011

(Continued)

*Primary Examiner* — Brent W Herring
(74) *Attorney, Agent, or Firm* — Andrew Wilford

(57) ABSTRACT

The invention relates to a ground anchor with a mounting (1) for a parasol or the like, having a sleeve (8) which is pushed over the mounting (1) and on which stabilizers (9, 10, 11) are mounted that can be folded out in a radial or preferably tangential manner. A ground screw (4) is connected to the mounting (1) on the ground side and opposite the object be supported, for example the parasol. A driver, such as a projecting section, a shoulder, or a nut (12) which can be screwed onto the mounting for example, drives the sleeve (8) during the screw-in process and expands the stabilizers (9, 10, 11) against the ground. The mounting (1) can be angled relative to the ground screw (4) by 90° and thus forms a lever for rotating the ground screw (4). The stabilizers (9, 10, 11) can be pivoted outwards in a tangential manner selectively clockwise as well as counterclockwise to a limited degree as a result of stops (14, 15).

5 Claims, 1 Drawing Sheet

(56) References Cited

U.S. PATENT DOCUMENTS

| | | | | | |
|---|---|---|---|---|---|
| 4,438,896 | A * | 3/1984 | Hall | F16M 11/046 | 248/168 |
| 4,566,661 | A * | 1/1986 | Mestler | A47B 3/00 | 108/150 |
| 4,832,304 | A * | 5/1989 | Morgulis | A01K 97/10 | 135/16 |
| 5,152,495 | A * | 10/1992 | Jacinto | E04H 12/2223 | 135/98 |
| 5,308,029 | A * | 5/1994 | Bingham | H01Q 1/1235 | 248/159 |
| 5,435,509 | A * | 7/1995 | Bingham | H01Q 1/1235 | 248/159 |
| 5,769,370 | A * | 6/1998 | Ashjaee | F16M 11/14 | 248/168 |
| 6,092,770 | A * | 7/2000 | Battocchio | F16M 11/16 | 248/166 |
| 6,450,464 | B1 * | 9/2002 | Thomas | F16M 11/34 | 248/163.1 |
| 7,246,783 | B2 * | 7/2007 | Harold | A45B 25/00 | 135/16 |
| 8,991,777 | B2 * | 3/2015 | Madril | E04H 12/347 | 248/206.5 |
| 9,629,427 | B1 * | 4/2017 | Alm | A45B 23/00 | |
| 2016/0318633 | A1 * | 11/2016 | Carreker | B64G 1/66 | |

FOREIGN PATENT DOCUMENTS

| | | | |
|---|---|---|---|
| EP | 1916752 | B | 7/2012 |
| WO | 2011112142 | A | 9/2011 |

* cited by examiner

GROUND ANCHOR WITH HOLDER FOR A LOAD

CROSS REFERENCE TO RELATED APPLICATIONS

This application is the US-national stage of PCT application PCT/EP2016/000019 filed 7 Jan. 2016 and claiming the priority of Austrian patent application A50023/2015 itself filed 15 Jan. 2015.

FIELD OF THE INVENTION

The invention relates to a ground anchor with a holder for receiving a load, particularly a parasol or the like, with a ground screw on the holder and with stabilizers for providing support against the ground.

BACKGROUND OF THE INVENTION

In order to hold and/or position objects such as a parasol, for example, on the ground, either heavy stands are set up or ground screws are used that are screwed into the ground and have a holder. The latter are light, easily transportable, and suitable for quickly setting up a parasol, which is then sufficiently secured against moderate wind pressure. It is of course also possible to stabilize other objects in this way, such as laundry stands, poles for signs, and tent stakes or guys thereof.

EP 1 916 752 discloses a fastening device for a temporary lightning protection mast that is used for a short time in conjunction with marquees. The lightning protection mast must be anchored well in the ground, and the metallic components must guarantee a low electrical transfer resistance. For this purpose, the ground screw has a hollow cylindrical head that receives the lightning protection mast, and radially projecting stabilizers that are welded to the screw head. The stabilizers act as handles while the ground screw is being screwed into the ground and are pressed flatly into the ground in order to provide additional ground contact over their entire length, thus providing a slight electrical transfer resistance. The transfer resistance can be further reduced by additional ground stakes. This results in a ground rod that simultaneously carries the lightning protection mast formed as a metallic rod.

DE 200 17 386 discloses a parasol stand with a ground screw that can be inserted into a holder formed as a pipe connector. When a nut is tightened, jaws of a clamping device in the pipe connector are pressed against the shaft of a parasol and fix the parasol in the holder. In addition, fold-out hand grips are connected to the holder that are used to screw the ground screw into the ground. No stabilizers for ground support are provided.

DE 2020 1001 6548 describes a device for receiving a pole on reinforced ground against tilting. There, the device begins with a threaded bolt that is fastened in the ground in a positive or nonpositive manner and onto which a support ring can be screwed in order to achieve a wide spanning in contact with the ground. The screw head for supporting the cross-bracing carries a sleeve into which a pole, such as for example the shaft of a parasol, can be inserted.

OBJECT OF THE INVENTION

It is the object of the invention to provide a ground anchor that has stabilizers for various soils such as sand, dirt, or for reinforced ground that is easy to transport and can be used in a wide range of applications.

SUMMARY OF THE INVENTION

This is achieved with a ground anchor of the type described above in that the holder is rotatably supported in a sleeve so as to be axially displaceable therein to an abutment, and in that the stabilizers are pivotal on the sleeve, can be swung out to a limited degree as a result of stops, and optionally extended telescopically or by being folded out. The ground screw, which can be freely rotated in the sleeve, can be either screwed into the ground or screwed onto a thread of the ground screw until the abutment on the holder reaches the upper edge of the sleeve. As the screwing continues, pressure is exerted from above onto the sleeve, and the sleeve is entrained vertically. The stabilizers are folded out or spread out and finally come into contact with the ground. As the holder is tightened, they are pressed against the ground, since the stops limit the swinging-out of the stabilizers to a predefined angle that is less than 90°, preferably 60°. This design ensures secure purchase in the ground. It is advantageous if the sleeve carries radially oriented holder pins for the stabilizers and the stabilizers can be pivoted on planes that are tangential to the sleeve. In contrast to the folding-out of the stabilizers on radial planes, the tangential arrangement according to the invention offers the advantage that the friction-induced torque acting on the sleeve is relieved in the longitudinal direction of the stabilizers as the holder is screwed in. Depending on the positioning of the stops for the stabilizers on the sleeves, the stabilizers are oriented tangentially to the sleeve in the clockwise direction or in the counterclockwise direction. If the stabilizers are oriented tangentially in the clockwise direction, a friction-induced torque acting in the clockwise direction brings about a release primarily via the tips of the stabilizers. If the stabilizers are oriented in the other counterclockwise direction, then the front regions of the stabilizers drag with increasing contact pressure over the ground until the friction with the ground is greater than the friction between the front face of the abutment and the sleeve. Depending on the nature of the ground, one or the other tangential pivoting-out direction will be preferred for the stabilizers. In the case of workable ground, it can be advantageous to orient the stabilizers tangentially against the clockwise direction. A hard ground meets the front faces of the clockwise oriented stabilizers and securely holds the stabilizers. In order to provide options, the stops can be provided on both sides of the radial holder stubs as similarly radial pins.

One embodiment is especially advantageous in which the abutment that limits the displaceability of the holder relative to the sleeve is annular and formed as a nut that is screwed onto an external screwthread of the holder that entrains the sleeve along during screwing-in of the holder or onto the holder and presses the spread stabilizers axially against the ground and pretensions them against the ground as the nut is tightened. The abutment constitutes a limit to the free displaceability of the holder in the sleeve. Starting at a certain screw-in depth, the holder entrains the sleeve axially and, by friction, in the clockwise direction as well. The friction can be reduced by sliding plates or ball bearings, and the transfer of a torque can be minimized or prevented. When the holder is securely screwed in, the nut that forms the annular abutment can be tightened further relative thereto, so that the stabilizers are braced against the ground.

As mentioned previously, the types of ground on which parasols, clotheslines, or the like are set up can vary greatly in terms of their firmness. This is why ground screws are used that differ in terms of length, thread diameter, and pitch. It is therefore advantageous if the ground screw is provided on the holder so as to be exchangeable. In the case of reinforced ground, a threaded bolt can also be set in concrete, and the holder can be screwed onto it.

Another especially practical embodiment is characterized in that the holder can be pivoted by 90° with respect to the ground screw and, in the angled position, forms a lever for screwing the ground screw, for example a ground screw, into the ground. As a result, an arbor as a separate lever for screwing in the holder or ground screw becomes unnecessary. The holder is simply folded over so that it forms a handle for the screwing-in of the ground screw. Once the ground screw is screwed in completely, then the holder is brought into the vertical position, the sleeve with the stabilizers is placed on it, and the nut (ring nut) is screwed onto the holder and tightened until the stabilizers are pretensioned against the ground. The fact that the holder has a hollow cylindrical design and a screw or plug or clamp connection to a pole (of a parasol, for example) or to the peg of an eye for a tensioning rope or the like. This results in an adequate replacement for a ground foundation or for a weight block (for example as a parasol stand), and a stable base for poles, supports, or hard point for braces or attachments.

BRIEF DESCRIPTION OF THE DRAWING

Embodiments of the invention are illustrated in the drawings, in which.

SPECIFIC DESCRIPTION OF THE INVENTION

Figure 1:
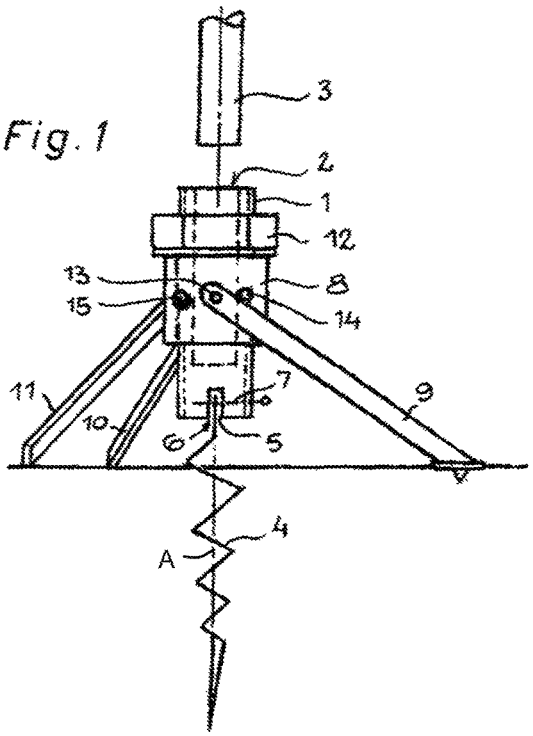
FIG. 1 shows a ground anchor with a holder for a parasol in the functional position.
Figure 4:
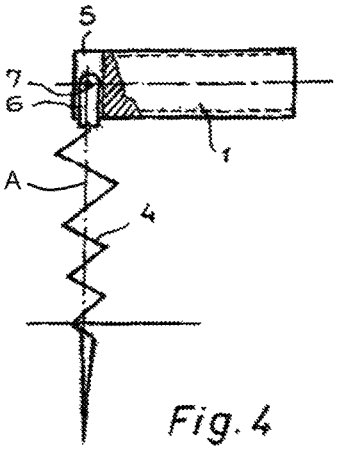
FIG. 4 shows a view with a folded-over holder as a handle for screwing of the screw into the ground.

According to FIG. 1, a holder 1 formed as a cylindrical tube has a hole 2 as a seat for a pipe 3, such as the pole of a parasol. Radial screws that secure the pipe 3 in the hole 2 are not shown. Instead of a pipe 3 or a pole, a peg having an eye as a fixing point for a guy can also be inserted. The holder 1 is equipped on its opposite, lower end with a positive connection (plug, snap, or screw connection) for a ground screw 4 or the like. In this embodiment, a slot 5 is shown that receives a head 6 of the ground screw 4 formed as a flat piece. A laterally removable pin 7 secures the head 6 in the slot 5. If the pin 7 is pulled out, then another screw or another anchoring element can be inserted that is suitable as a base for the ground type (dirt, sand, compacted material, concrete). FIG. 4 shows one possibility for the screwing-in of the ground screw 4 into the ground. The holder 1 is pivoted by 90° with respect to the ground screw 4. This is possible with the slotted connection shown here as an example, with the pin 7 forming the pivot axis. The holder 1 acts as a lever or hand grip that enables torque to be applied to the ground screw 4. As soon as the ground screw 4 has been screwed completely into the ground and is securely seated, the holder 1 is brought again into the position according to FIG. 1, a sleeve 8 with three stabilizers 9, 10, 11 is pushed over the holder 1, and a nut 12 is screwed onto an external screwthread of the holder 1 to lock it down. This nut 12 can be a wing nut. The stabilizers 9, 10, and 11 are hinged on the sleeve 8 by radial pivot pins 13 and can thus pivot in a vertical plane that is tangential to the sleeve 4. As shown particularly in FIG. 1, the pivot angle is limited by stops 14, 15. If the nut 12 is screwed vertically downward, then it presses the sleeve 8 downward and the spread stabilizers 9, 10, 11 against the ground. The friction between the nut 12 and the sleeve 8 can be reduced by means of a washer made of Teflon, for example, or by a ball thrust bearing. Nevertheless, residual torque is transferred to the sleeve 8, which is rotated slightly along until the friction of the stabilizers 9, 10, 11 against the ground is substantial and the sleeve 8 is rotationally stabilized. An equilibrium is then established between the supporting forces of the stabilizers 9, 10, 11 against the ground and the holding force of the ground screw 4 as well as of the tensile force of the nut 12, which results in a high level of static strength.

Figure 2:
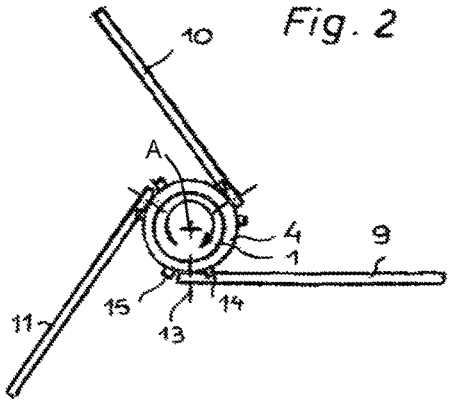
FIG. 2 shows a top view with removed abutment with stabilizers folded out and angled counterclockwise.
Figure 3:
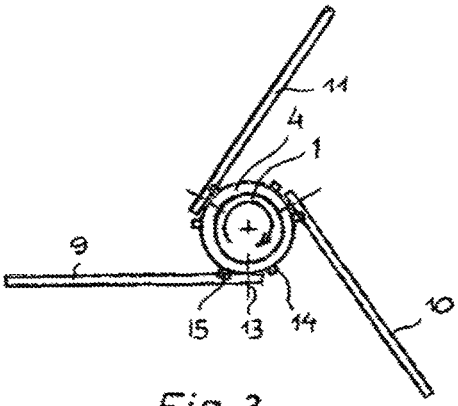
FIG. 3 shows an alternative similar to FIG. 2 but with stabilizers folded out and angled clockwise.

The embodiment according to FIG. 1 permits pivot angles of the stabilizers 9, 10, 11 in the clockwise direction and in the counterclockwise direction, as is shown in FIGS. 2 and 3.

The torque transferred to the sleeve 8 on screwing in the ground screw 4 and during the tightening of the nut 12 (direction of the arrow in FIGS. 2 and 3) is converted according to FIG. 2 into a sliding of the stabilizers 9, 10, 11 until a frictional connection is established. If the stabilizers 9, 10, 11 according to FIG. 3 are oriented in the counterclockwise direction, then the front faces of the stabilizers press against the ground like a pawl. For soft ground (for example sand), the variant according to FIG. 2 is advantageous, whereas the variant according to FIG. 3 is advantageous for a hard ground.

It should also be mentioned that, in the alternative of FIG. 4, the ground screw can be screwed in using a separate lever that is inserted into a cross bore through the holder 1. In this way, the stabilizers 9, 10, and 11 can also be tensioned against the ground. Instead of the nut 12, an abutment, such as an offset or a shoulder on the lateral surface of the holder 1, can be provided on the holder 1 that abuts against the sleeve 8 when the ground screw 4 is screwed in and carries the latter along under simultaneous pretensioning of the stabilizers 9, 10, 11. The lever can be given a central place in the hole 2 when the pipe 3 is open at the bottom. Furthermore, the ground screw 4 can also be a threaded bolt that is anchored in the ground onto which the holder 1 is screwed.

The invention claimed is:

1. A ground anchor comprising:

a holder for receiving a load and defining an axis;

a ground screw on the holder;

a sleeve rotatable and axially displaceable on the holder;

radial pivot pins on the sleeve;

respective stabilizers for providing support against the ground and pivotal on the pivot pins of the sleeve in respective planes tangential to the sleeve;

an annular abutment axially limiting movement of the sleeve on the holder and entraining the sleeve during screwing in of the ground screw to press the spread stabilizers axially against the ground and pretension them against the ground as the ground screw is screwed in; and respective stops on the sleeve limiting pivoting of the stabilizers.

2. The ground anchor defined in claim 1, wherein the abutment that limits the displaceability of the holder relative to the sleeve is formed as a nut screwed onto an external screwthread of the holder to entrain the sleeve during screwing-in of the holder and press the spread stabilizers axially against the ground and pretension them against the ground as the nut is tightened.

3. The ground anchor defined in claim 1, wherein the ground screw is removably mounted on the holder so as to be exchangeable.

4. The ground anchor defined in claim 1, wherein the holder is of tubular cylindrical design and a screw or plug or clamp serves for connection to a pole, or for the peg of an eye for a tensioning rope.

5. A ground anchor comprising:

a holder for receiving a load and defining an axis;

a ground screw on the holder;

a sleeve rotatable and axially displaceable on the holder;

stabilizers for providing support against the ground and pivotal on the sleeve;

an abutment axially limiting movement of the sleeve on the holder; and respective stops on the sleeve limiting pivoting of the stabilizers, the holder being pivotal by 90° with respect to the ground screw and, in an angled position, forming a lever for screwing the ground screw into the ground.

* * * * *